US005180452A

United States Patent [19]

Lund et al.

[11] Patent Number: 5,180,452

[45] Date of Patent: Jan. 19, 1993

[54] SOLID PROPELLANT FORMUALTIONS PRODUCING ACID NEUTRALIZING EXHAUST

[75] Inventors: Gary K. Lund, Ogden; Mark J. Spinti, Salt Lake City; Daniel W. Doll, North Ogden, all of Utah

[73] Assignee: Thiokol Corporation, Ogden, Utah

[21] Appl. No.: 634,391

[22] Filed: Dec. 27, 1990

[51] Int. Cl.[5] ..... C06B 45/10

[52] U.S. Cl. ..... 149/19.9; 149/19.1; 149/20; 149/76

[58] Field of Search ..... 149/19.1, 19.4, 19.9, 149/20, 76

[56] References Cited

U.S. PATENT DOCUMENTS

| | | | |
|---|---|---|---|
| T104,801 | 11/1984 | Rozycki | 181/119 |
| 3,010,814 | 11/1961 | Carr | 149/19.9 |
| 3,056,701 | 10/1962 | Fritzlen | 149/15 |
| 3,133,842 | 5/1964 | Kuehl | 149/19.3 |
| 3,138,502 | 6/1964 | Barr et al. | 149/109 |
| 3,180,770 | 4/1965 | Mills et al. | 149/19.4 |
| 3,725,516 | 4/1973 | Kaufman | 149/19.3 |
| 3,779,008 | 12/1973 | Henderson et al. | 149/19.1 |
| 3,793,099 | 2/1974 | Duerksen et al. | 149/19.4 |
| 3,841,929 | 10/1974 | Craig | 149/19.1 |
| 3,865,035 | 2/1975 | Munson et al. | 149/38 |
| 3,914,141 | 10/1975 | Sayles | 149/19.3 |
| 3,956,890 | 5/1976 | Davis | 149/19.4 |
| 3,986,906 | 10/1976 | Sayles | 149/19.4 |
| 4,016,199 | 4/1977 | Shoults et al. | 149/119 |
| 4,158,583 | 6/1979 | Frosch | 149/19.4 |
| 4,236,464 | 12/1980 | Anderson et al. | 110/238 |
| 4,365,557 | 12/1982 | Couture et al. | 102/341 |
| 4,427,468 | 1/1984 | Duchesne et al. | 149/19.9 |
| 4,642,147 | 2/1987 | Hyyppä149 | 19.9/ |
| 4,824,495 | 4/1989 | Verneker | 149/7 |
| 5,076,868 | 12/1991 | Doll et al. | 149/19.4 |

*Primary Examiner*—Edward A. Miller
*Attorney, Agent, or Firm*—Madson & Metcalf

[57] ABSTRACT

Scavenging and neutralization of HCl from the exhaust plume of a solid grain rocket motor is achieved by including elemental magnesium as the sole metallic component. The magnesium acts both as a propellant fuel and as a scavenger of halogen acids derived form the halogenic oxidizer. Combustion of the high energy propellant produces an exhaust plume from which the halogen acids are scavenged.

18 Claims, 3 Drawing Sheets

SOLID PROPELLANT FORMUALTIONS PRODUCING ACID NEUTRALIZING EXHAUST

BACKGROUND OF THE INVENTION

Field of the Invention

This application relates generally to the field of solid rocket propellants. More particularly, the invention pertains to the reduction of halogen acids in the combustion exhaust plume from solid rocket propellants containing ammonium perchlorate or other halogen containing materials.

State of the Art

Solid rocket propellants containing ammonium perchlorate or other halogenic components may produce large quantities of acids, e.g. hydrochloric acid, which appear in the exhaust plume. For example, each space shuttle flight has consumed about 773 tons of an oxidizer ammonium perchlorate in the booster rockets. Approximately 230 tons of free hydrochloric acid (HCl) immediately appears in the exhaust from such flights. Thus, about 95 percent of the total quantity of perchlorate is converted to HCl, and the products of combustion comprise nearly 20 percent HCl by weight. Some of the hydrochloric acid is subsequently converted to non-acid forms, e.g. aluminum chloride, but about 55+ percent remains as acid.

The acid produced is a serious hazard to the health of persons in the immediate vicinity and downwind from the launch site. In addition, the acid is extremely corrosive and produces rapid deterioration of the launch facilities and other structures which are downwind. Long-term harmful effects are also produced in the indigenous plant and animal life of the area.

Recognizing the deleterious environmental and health effects of the acidic plume, the government has proposed that non-halogen containing oxidizers be developed for use in large rocket systems replacing the ammonium perchlorate (AP). All substitutes to date have been unsatisfactory from the standpoints of mechanical properties, ballistic properties, ease of production, and/or safety. Desirably, the new propellant will (a) result in halogenic plume acids less than 5 percent of that produced by current generation motors; (b) be no more difficult to prepare, mold and cure than currently used space shuttle solid rocket propellants; (c) perform ballistically as well as or better than current propellants in terms of specific impulse Isp, burn rate and efficiency; (d) have the required structural properties for consistent combustion and safety; (e) be capable of having its burn rate readily tailored over a wide range; (f) have ignition characteristics of a Class 1.3 hazard, i.e. a 0-card goal; and (g) be low in cost. In addition, long-term stability of the propellant is required.

The current state-of-the-art reduced acid propellant uses sodium nitrate as a halogen scavenger. Although removal of the halogen acid may be generally high, the propellant has several drawbacks including low burn rates R, a low specific impulse Isp and difficulties in processing. In addition, the range of burn rates is generally constricted to the narrow limits of about 0.32 to 0.42 inches per second.

New propellants have been devised for reducing or eliminating the halogen acids. Such propellants use a halogen free material in combination with ammonium nitrate as the oxidizer, but the burn rates, specific impulse and strain capability are unacceptably low. In addition, the propellant cost is prohibitive.

The need remains for an inexpensive, readily prepared and high performing propellant system in which halogenic acids do not appear in the exhaust gases or are scavenged from the exhaust plume shortly after discharge from the nozzle, either quantitatively or to a very low level.

SUMMARY OF THE INVENTION

This invention comprises a method for eliminating or greatly reducing halogenic acids such as hydrochloric acid from composite solid-grain rocket motor exhaust. In this invention, all elemental metal components of the propellant are eliminated except for one or more of magnesium, lithium, calcium or strontium. Thus, the magnesium, lithium, calcium and/or strontium is essentially the sole metallic component of the fuel and acts both as a primary fuel and as a halogen scavenger. The aluminum currently used in most solid rocket motors is preferably eliminated completely. It is desirable that metals other than Mg, Li, Ca and Sr are limited to less than about 3.0 percent of the propellant formulation.

Preferably, the metal is added to the propellant composition on an equivalence basis of about 2.5 to 4.0 equivalents metal per equivalent of halogen in the formulation. Thus, for a propellant formulation containing 70 percent ammonium perchlorate, the preferred concentration of magnesium, for example, is about 19 to 27 percent by weight of the formulation. More preferably, the metal is added at an equivalence basis of about 2.8 to 3.6.

While lithium, calcium and strontium may be used as complete substitutes for aluminum, they have mechanical and ballistic properties, and/or cost which make them unattractive. The preferred metal for use in this invention is magnesium, which has been found to provide good mechanical and ballistic properties, high acid removal, processing ease, safety and relatively low cost.

Propellants currently used in such programs as the space shuttle solid rocket booster use aluminum as the metallic fuel component and ammonium perchlorate (AP) as the oxidizer. The AP content of the propellant is typically about 60 to 70 percent. Thus, the chloride in the oxidizer ammonium perchlorate comprises about 18 to 21 percent of the total propellant weight. Upon combustion, it appears largely in the exhaust as hydrochloric acid. In space shuttle flights, the free hydrochloric acid content of the plume is known to comprise about 21 percent of the combustion products. The substitution of magnesium for aluminum in the formulation results in an exhaust cloud from which the chloride ion is essentially quantitatively scavenged by the metal to produce the benign solid metallic chloride, i.e. magnesium chloride $MgCl_2$. Differing scavenging reactions take place both within the rocket combustion chamber and in the exhaust plume itself. The major reactions which remove the acid are dependent upon the presence of condensed water in the plume. The water present in the plume is a combustion product arising principally from hydrogen liberated from the organic binder materials.

Use of magnesium as a fuel/scavenger in the ammonium perchlorate based propellants has been found to enable the burn rate to be tailored over a wide range with the use of small quantities of iron oxide, e.g. ferric oxide.

Propellants which utilize magnesium as the sole metallic component have been found to be very similar to current space shuttle booster motor propellant in processability and mechanical properties.

DESCRIPTION OF THE PREFERRED EMBODIMENTS

Figure 1:
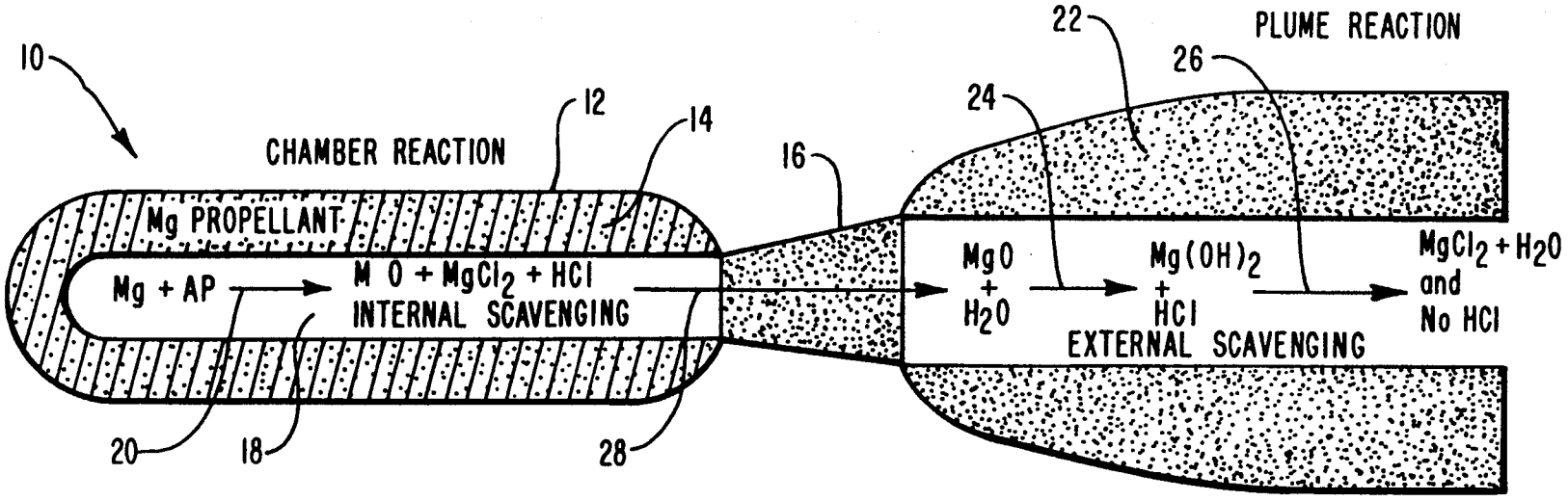
FIG. 1 is a schematic view of a solid rocket motor showing the chemical reactions taking place within the combustion chamber and in the external plume in accordance with the invention.

The two stage chemical mechanism for hydrochloric acid scavenging from a rocket motor exhaust is depicted in FIG. 1. Solid propellant rocket motor 10 includes a casing 12 containing a solid propellant grain 14 and an integral combustion chamber 18. Nozzle 16 is attached to the casing 12 for the ejection of combustion products to form plume 22.

Many chemical reactions take place in the combustion chamber 18. The combustion products include magnesium oxide, carbon dioxide, hydrochloric acid, nitrogen, nitrogen oxides, water vapor and various ionic species. The reactions relating particularly to the formation of hydrochloric acid and to the scavenging of the acid by means of the invention, are as follows:

Combustion within the chamber 18 includes simplified reaction 20 by which magnesium Mg and ammonium perchlorate AP form magnesium oxide MgO, hydrochloric acid HCl, a relatively small quantity of magnesium chloride $MgCl_2$, and other products not shown. Thus, a small amount of internal scavenging by magnesium occurs at the high combustion temperatures and pressures, typically up to about 1000 psi at 2000 to 6000 degrees F.

Combustion products 28 discharged from the rocket 10 include not only the species listed but hydrogen $H_2$ as well. The latter is a combustion product primarily of the organic polymeric binder material and is believed to be a prerequisite for complete conversion of the halogen acid to innocuous magnesium chloride in the plume 22.

Commonly used, halide-free propellant binders which are useful in the invention include hydroxyl-terminated polybutadiene (HTPB), polybutadiene acrylonitrile acrylic acid terpolymer (PBAN) and carboxy-terminated polybutadiene (CTPB). These binder materials may be used separately or in combination.

In plume 22, cooling and condensation of the combustion products occurs. As theorized in reaction 24, hydrogen $H_2$ is oxidized to water. Magnesium oxide reacts with the condensed water to form magnesium hydroxide $Mg(OH)_2$ which further reacts with the halogen acid in reaction 26 to form magnesium chloride. As shown in the examples infra, the hydrochloric acid may be removed quantitatively or nearly so by the use of magnesium as the sole metal in an AP based propellant.

Preferably, the magnesium is combined in the propellant batch as a particulate material in which the major weight portion has particle sizes in the range of between about 90 microns and 1.0 millimeter.

In a preferred form of the invention, the ammonium perchlorate particle size distribution is bimodal. The majority of the oxidizer has particle sizes in the 15–100 micron range and in the 150–400 micron range. Preferably, at least 80 weight percent of the particles fall into those size ranges.

More particularly, the bimodal peak concentrations fall within the 15–45 micron range and 150–250 micron range.

For the purposes of the invention, ammonium perchlorate represents any halogen-containing propellant component, and magnesium represents any of the metals magnesium, calcium, lithium, and strontium. Magnesium is the preferred metal, but any of these metals or combinations thereof may be used.

The requirements for a practical acid-scavenging rocket propellant not only include effective acid removal and the satisfactory ballistic performance factors, but also ease of production, safety, tailorability of burn rate, low cost, and other considerations. The propellant of the invention is shown in the following examples to excel in each of these areas.

EXAMPLE 1

The incorporation of metallic magnesium as a halide acid scavenging agent in an ammonium perchlorate (AP) based propellant was evaluated in small scale tests. The aluminum fuel was partially or wholly replaced by magnesium. Comparisons were made with the state-of-the-art, low-acid propellant which uses sodium nitrate as an acid scavenger. In all tests, the propellant included 12 percent total of an HTPB/IPDI binder and bonding agent. Small, i.e. one-gallon, batches of propellant were made according to the formulations A through F of the table below. One to five gram samples of the cured propellants were combusted in a closed combustion bomb containing 250 ml water. The combustion products entrained in the water were analyzed for chloride ion and free HCl. The specific impulse Isp, burn rate R, and burn rate pressure exponent n were also determined or calculated for each propellant sample. The test results were as indicated in the following table, columns A through F. Column G indicates the composition and typical burning characteristics of the currently used space shuttle booster solid propellant. A propellant formulation of the invention could be used to replace the current space shuttle formulation of column G in order to eliminate the hydrochloric acid in the exhaust plume.

| Propellant | A | B | C | D | E | F | G |
|---|---|---|---|---|---|---|---|
| % AP | 38.65 | 65.5 | 38.4 | 62.5 | 67.0 | 19.5 | 69.75 |
| % Al | 21.0 | 0.0 | 18.0 | 15.0 | 10.0 | 18.0 | 16.0 |
| % Mg | 0.0 | 22.0 | 3.0 | 10.0 | 11.0 | 3.0 | 0.0 |
| % $NaNO_3$ | 28.1 | 0.0 | 28.1 | 0.0 | 0.0 | 25.0 | 0.0 |
| % AN | 0.0 | 0.0 | 0.0 | 0.0 | 0.0 | 25.0 | 0.0 |
| % $Fe_2O_3$ | 0.25 | 0.5 | 0.5 | 0.5 | 0.0 | 0.5 | 0.2 |
| Equiv. Mg/ Equiv. Cl | 0.00 | 3.25 | 0.76 | 1.54 | 1.58 | 1.50 | 0.00 |
| Isp, seconds | 259.9 | 274.3 | 258.9 | 275.7 | 274.9 | 269.9 | 278.4 |
| Density, lb./in.$^3$ | 0.068 | 0.061 | 0.067 | 0.064 | 0.063 | 0.064 | 0.064 |
| Burn rate, ips | 0.350 | 0.574 | 0.365 | 0.474 | 0.424 | 0.278 | 0.43 |
| Pressure exponent, n | 0.42 | 0.43 | 0.38 | 0.35 | 0.46 | 0.47 | 0.35 |

-continued

| Propellant | A | B | C | D | E | F | G |
|---|---|---|---|---|---|---|---|
| % chloride ions in exhaust products | 11.08 | 18.92 | 10.79 | 17.69 | 18.90 | 8.01 | 21.00 |
| % acid (as HCl) in exhaust products | 3.5 | 0.0 | 2.58 | 10.10 | 6.75 | 3.83 | 20.00 |
| % acid removed | 69.3 | 100.0 | 76.7 | 44.5 | 65.3 | 53.5 | <5 |

Propellant A is a state-of-the-art low-acid formulation which uses sodium nitrate as a halogen scavenger. The resulting acid removal was low, i.e. less than 70 percent. In addition, the specific impulse Isp was low.

Propellant B is a propellant formulation, according to the present invention, in which all metallic aluminum is replaced with magnesium. No sodium nitrate was used. Quantitative acid removal was achieved, and a high specific impulse resulted. The burn rate was considerably higher than that of baseline propellant A.

In propellants C, D, E and F, aluminum was partially replaced with magnesium. The presence of aluminum hindered acid scavenging even when a large quantity of sodium nitrate was included (propellants C and F) and when AP was largely replaced by energetic material ammonium nitrate (propellant F).

Figure 2:
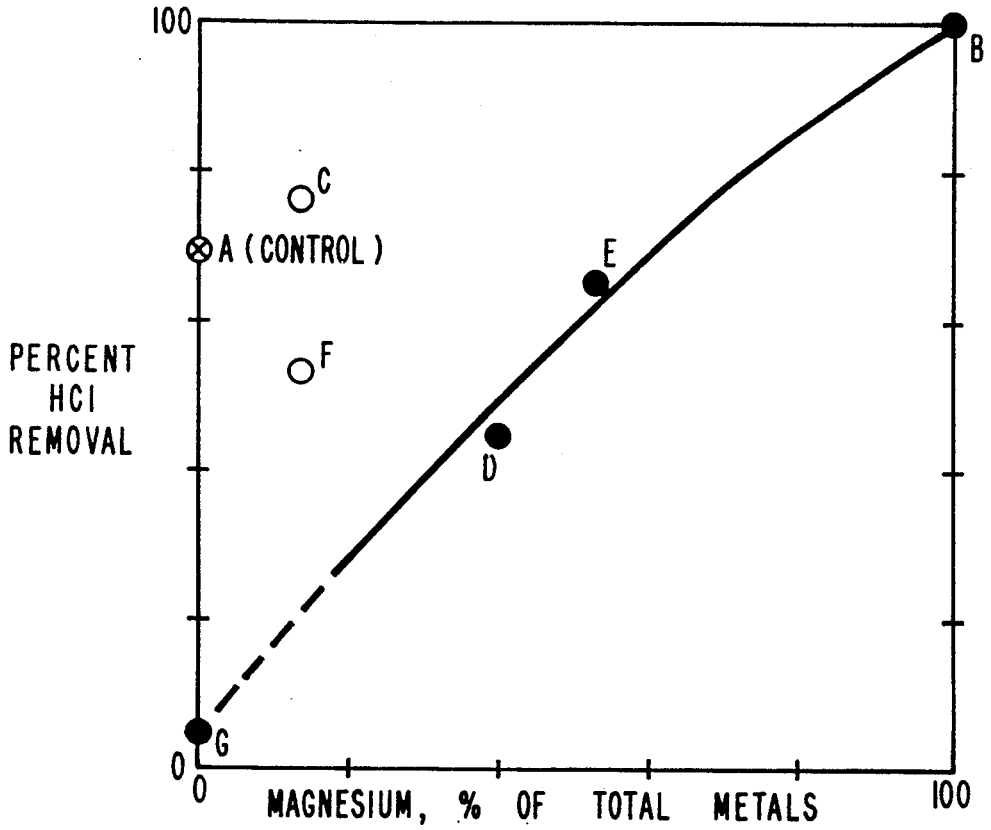
FIG. 2 is a graph of the results of tests showing the effect of magnesium content and aluminum content upon the removal of hydrochloric acid from rocket motor exhaust.

The results are plotted in FIG. 2 and indicate that aluminum in the propellant hinders removal of HCl from the plume.

Comparison of propellant B with the current shuttle booster propellant G shows that the acid scavenging formulation B provides specific impulse which is slightly below that of propellant G. The burn rate R is higher, and the pressure exponent n is also higher in propellant B.

EXAMPLE 2

Propellants having the following compositions were prepared in five, one-gallon mixes:

| Component | Weight Percent |
|---|---|
| Binder | 15.0 |
| Oxidizer | |
| AP (nominal 200 micron) | 39.9 |
| AP (nominal 20 micron) | 23.0 |
| Total | 62.9 |
| Fuel | 22.0 |
| Magnesium | |
| Catalyst | 0.05, 0.10 and 0.15 |
| $Fe_2O_3$ | |

Figure 3:
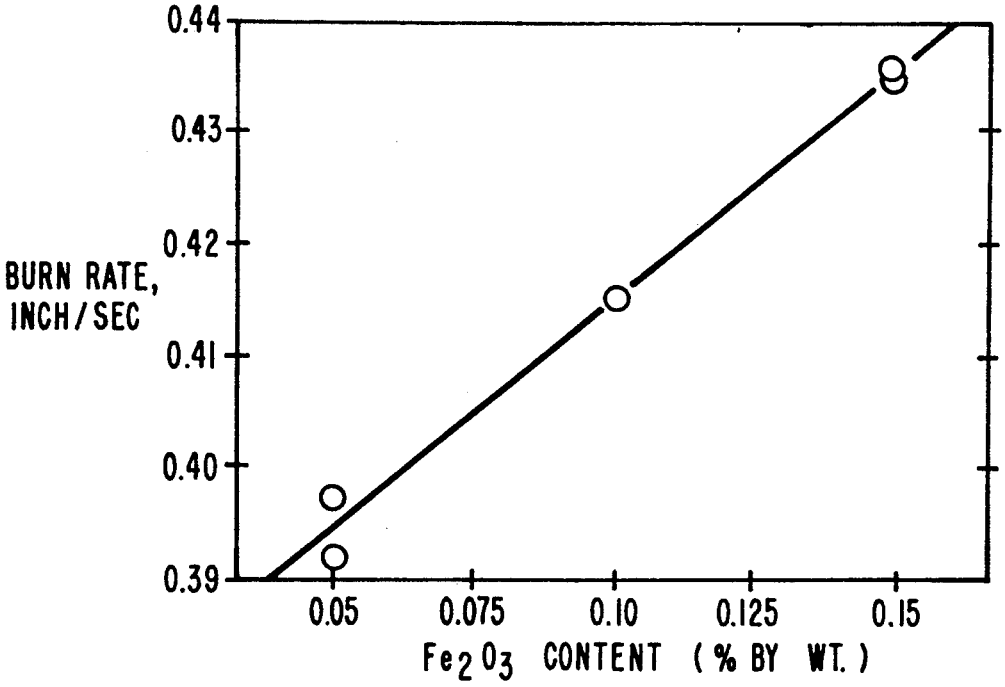
FIG. 3 is a graphical representation of the effect of iron oxide upon the burn rate of the propellant of the invention.

Center perforated 70-gram motors were cast, cured for seven days at 135° and fired. The results are plotted in FIG. 3 and show a good correlation between catalyst concentration and burn rate R at 1000 psi. Regression analysis yielded a straight line relationship of:

$$\text{Rate } R = 0.37278 + 0.42000\ (Fe_2O_3)$$

with a statistical variance of 0.003. Thus, the burn rate is readily and accurately controllable over a wide range using ferric oxide.

The burn rate is affected by various factors, particularly by variations in the concentrations of constituents in the formulation. Thus, the ferric oxide concentration required to obtain a particular burn rate may vary from as little as 0.0001 percent to as much as about 1.0 percent by weight. For most useful formulations, about 0.001 to 1.0 percent ferric oxide will be found useful.

EXAMPLE 3

Propellant formulations of the following compositions were prepared and manufactured in 70 gram motors. The hydrochloric acid content of the exhaust was evaluated for each 70 gram motor and compared to space shuttle propellant.

| Ingredient | Space Shuttle | Mg/6% Al | $NaNO_3$ #1 | $NaNO_3$ #2 | Mg/No Al |
|---|---|---|---|---|---|
| AP | 69.75 | 62.5 | 38.5 | 39.5 | 62.5 |
| $NaNO_3$ | — | — | 28.0 | 29.0 | — |
| Al | 16.00 | 6.0 | 21.0 | 19.0 | — |
| Mg | — | 16.0 | — | — | 22.0 |
| $Fe_2O_3$ | 0.25 | 0.5 | 0.5 | 0.5 | 0.5 |

Each propellant was fired as a 70-gram center perforated motor at 1000±100 psi. The exhaust was captured in a plume sampling device 10 feet from the nozzle exit plane. The sampling device was placed in the stream of the motor plume to capture exhaust in polyethylene bags.

The captured exhaust samples were analyzed for HCl with increasing time after the firing. HCl-specific Drager tubes were inserted into the polyethylene bags for visually reading the acid value.

Figure 4:
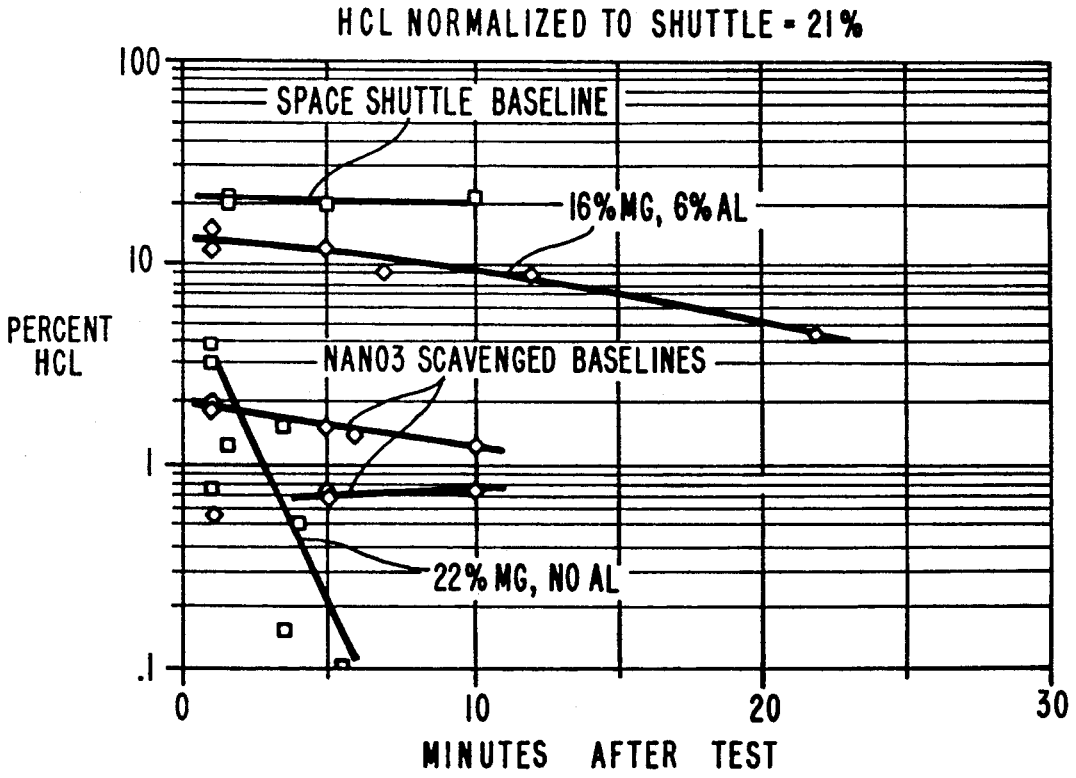
FIG. 4 is a graphical comparison of the time degradation of HCl content in the exhaust plumes from a magnesium based propellant of the invention and the current space shuttle booster propellant.

In FIG. 4, data points from all of the test firings are shown as well as comparative data from current shuttle booster propellant batches. In all tests, the halide content of the shuttle booster propellant, expressed as maximum potential HCl in the exhaust, was 21.0 percent.

The results in FIG. 4 illustrate the effectiveness of magnesium as a scavenger for hydrochloric acid. The HCl in the exhaust plume immediately after firing was significantly reduced and declined to a negligible value with increasing time.

The theoretical HCl content of the plume gas at zero time at the nozzle exit plane for the magnesium based propellant was determined from the NASA Lewis thermochemistry code to be 13.8 percent. This is much higher than the actual data collected just after zero time. This may be attributed to either or both of the following:

(a) The magnesium initially scavenges the HCl to a much greater degree than theoretically calculated and/or.

(b) Extremely rapid scavenging occurs in the first two minutes after the end of motor burn.

As shown previously (FIG. 2), the partial replacement of Mg metal with Al metal inhibits the acid scavenging. FIG. 4 illustrates that the HCl scavenging efficiency of the Mg metal is diminished with the addition of 6% Al relative to the composition with no Al.

There appears to be some scatter in the analyses. This scatter is attributable in part to varying atmospheric conditions and inherent variability in visually reading the acid concentration from the Drager tube.

It is evident that considerable acid scavenging of HCl from the combustion products occurs prior to exit from the nozzle. The scavenging rapidly continues in the plume, however, until the HCl content is neutralized to a negligible or zero value.

Reference herein to details of the particular embodiments is not intended to restrict the scope of the appended claims which themselves recite those features regarded as important to the invention.

We claim:

1. A composite solid rocket propellant formulation comprising:

from about 60% to about 70% ammonium perchlorate;

from about 19% to about 27% free metal, said metal acting both as a fuel within the propellant formulation and as a chloride ion scavenger, such that upon burning the propellant, substantially all of the chloride ion produced reacts with said free metal, said free metal being selected from the group consisting of lithium, calcium, strontium, and magnesium, said free metal having a particle size of from about 90 microns to about 1 millimeter;

between about 0% and 3% free metal other than said free metal fuel and chloride ion scavenger;

from about 0.0001% to about 1.0% burn rate catalyst;

from about 5% to about 21% halogen-free binder.

2. A composite solid rocket propellant formulation as defined in claim 1 wherein said burn rate catalyst comprises iron oxide.

3. A composite solid rocket propellant formulation as defined in claim 1 wherein said free metal fuel and chloride scavenger comprises from about 2.5 to about 4.0 equivalents per equivalent of chlorine present in the formulation.

4. A composite solid rocket propellant formulation as defined in claim 1 wherein said free metal fuel and chloride scavenger comprises from about 2.8 to about 3.6 equivalents per equivalent of chlorine present in the formulation.

5. A composite solid rocket propellant formulation as defined in claim 1 wherein said binder comprises hydroxy-terminated polybutadiene.

6. A composite solid rocket propellant formulation of the type which produces reactive chloride ion upon burning as defined in claim 1 wherein said binder comprises polybutadiene acrylonitrile acrylic acid terpolymer.

7. A composite solid rocket propellant formulation as defined in claim 1 wherein said binder comprises carboxy-terminated polybutadiene.

8. A composite solid rocket propellant formulation as defined in claim 1 wherein at least about 80% of said ammonium perchlorate exits as particles in the range of from about 15 microns to about 400 microns.

9. A composite solid rocket propellant formulation as defined in claim 1 wherein at least about 80% of said ammonium perchlorate exists as particles in the ranges of from about 15 microns to about 45 microns and from about 150 microns to about 250 microns.

10. A method for substantially eliminating the formation of hydrochloric acid upon the burning of a rocket motor propellant, which propellant would otherwise produce reactive chloride ion, the method comprising the steps of:

providing a rocket motor propellant comprising from about 60% to about 70% ammonium perchlorate; from about 19% to about 27% free metal, said metal acting both as a fuel within the propellant formulation and as a chloride ion scavenger, said free metal being selected from the group consisting of lithium, calcium, strontium, and magnesium, said free metal having a particle size of from about 90 microns to about 1 millimeter; from about 0.0001% to about 1.0% burn rate catalyst; and from about 5% to about 21% halogen-free binder; and burning said propellant such that substantially all of the chloride ion produced during burning reacts with said free metal fuel and chloride scavenger.

11. A method for substantially eliminating the formation of hydrochloric acid upon the burning of a rocket propellant, as defined in claim 10 further comprising the step of placing the propellant within a rocket motor casing, said casing having an attached nozzle.

12. A method for substantially eliminating the formation of hydrochloric acid upon the burning of a rocket propellant, as defined in claim 11 wherein upon burning of the propellant, a portion of said chloride ion is scavenged by said free metal fuel and chloride scavenger within said casing.

13. A method for substantially eliminating the formation of hydrochloric acid upon the burning of a rocket propellant, as defined in claim 11 wherein upon burning of the propellant, a portion of said chloride ion is scavenged by said free metal fuel and chloride scavenger outside of said nozzle.

14. A composite solid rocket propellant formulation producing a hydrochloric acid-neutralizing exhaust, comprising:

from about 60% to about 70% particulate ammonium perchlorate oxidizer;

from about 19% to about 27% free metal selected from the group consisting of lithium, calcium, strontium, and magnesium; and from about 5% to about 21% halogen free liquid aliphatic rubber binder; and at least one burn rate catalyst;

said composition being substantially free of any other free metals, such that upon burning said free metal defined above scavenges substantially all of the chloride ion produced.

15. A composite solid rocket propellant formulation producing a hydrochloric acid-neutralizing exhaust as defined in claim 14 wherein said free metal comprises particles of from about 90 microns to about 1 millimeter.

16. A composite solid rocket propellant formulation producing a hydrochloric acid-neutralizing exhaust as defined in claim 14 wherein said ammonium perchlorate comprises particles sized between about 15 microns and about 100 microns, and from about 150 microns and about 400 microns.

17. A composite solid rocket propellant formulation producing a hydrochloric acid-neutralizing exhaust as defined in claim 14 wherein said burn rate catalyst comprises iron oxide.

18. A composite solid rocket propellant formulation producing a hydrochloric acid-neutralizing exhaust as defined in claim 14 wherein said binder is selected from the group consisting of hydroxy-terminated polybutadiene, PBAN, and CTPB.

* * * * *